US006863155B2

(12) United States Patent
Wyse et al.

(10) Patent No.: US 6,863,155 B2
(45) Date of Patent: Mar. 8, 2005

(54) MOBILE SCAFFOLDING BRAKE

(76) Inventors: Steven J. Wyse, 82 Pin Oak, Archbold, OH (US) 43502; James L. Wyse, 13324 County Rd. 12, Middlebury, IN (US) 46540

( * ) Notice: Subject to any disclaimer, the term of this patent is extended or adjusted under 35 U.S.C. 154(b) by 0 days.

(21) Appl. No.: 10/271,634

(22) Filed: Oct. 15, 2002

(65) Prior Publication Data

US 2004/0069568 A1 Apr. 15, 2004

(51) Int. Cl.[7] ..... E06C 7/16
(52) U.S. Cl. ..... 182/118
(58) Field of Search ..... 182/118, 119, 182/117, 116, 115, 152, 15, 113, 17, 141

(56) References Cited

U.S. PATENT DOCUMENTS 2,827,215 A * 3/1958 Burg et al. ..... 182/15
3,112,010 A * 11/1963 Mihalik ..... 182/113
3,236,331 A * 2/1966 Green ..... 182/144
3,429,398 A * 2/1969 Reynolds et al. ..... 182/13
3,858,688 A * 1/1975 Galloway ..... 182/141
4,944,366 A * 7/1990 Pryor et al. ..... 182/141
5,588,500 A * 12/1996 Yonahara ..... 182/141
6,471,003 B2 10/2002 Wyse

OTHER PUBLICATIONS

Winter Construction Equipment Internet publication for "Q–BRAKE" device (published at www.qbrake.com at lease as early as Dec. 20, 2002).

* cited by examiner

*Primary Examiner*—Hugh B. Thompson, II
(74) *Attorney, Agent, or Firm*—Hovey Williams LLP

(57) ABSTRACT

A mobile scaffolding (10) for elevating a worker (not shown) above a floor or ground surface (S) is disclosed. The scaffolding (10) broadly includes a pair of frames (12) and (14), a platform (16) supported by the frames (12,14), a pair of casters (18, 20) and (22,24) rollably supporting a respective one of the frames (12,14), and a brake assembly (26, 28,30, and 32) associated with a corresponding one of the casters (18,20,22,24), respectively. The inventive brake assemblies (26,28,30,32) enable the worker supported on the platform (16) to selectively activate and deactivate the respective brake assemblies (26,28,30,32) from the platform (16). This enables the worker supported on the platform (16) to deactivate the brake assemblies (26,28,30,32), reposition the scaffolding (10), and then reactivate the brake assemblies (26,28,30,32) without requiring the worker to dismount from the platform (16).

19 Claims, 3 Drawing Sheets

MOBILE SCAFFOLDING BRAKE

BACKGROUND OF THE INVENTION

1. Field of the Invention

The present invention relates generally to mobile scaffolding. More specifically, the present invention concerns a mobile scaffolding brake that can be activated from the support platform and when activated restrains motion of the scaffolding. The inventive brake enables a worker supported on the scaffolding platform to selectively prevent unsafe and inadvertent motion of the scaffolding while the worker is supported thereon.

2. Discussion of Prior Art

It is known in the art to utilize scaffolding to provide an elevated work platform to elevate a worker above a floor or ground surface to complete a task (e.g., painting, drywall finishing, etc.). The scaffolding utilized to provide the elevated work platform is often mobile scaffolding that can be quickly and easily moved from one working position to the next. For example, it is known in the art to support a scaffolding frame with one or more casters that enable the assembled scaffolding to be rolled along the floor or ground surface between working positions. However, it is desirable to prevent the scaffolding from moving when one or more workers are supported thereon.

It is known in the art to provide a scaffolding caster with a brake for selectively preventing the scaffolding from moving. These prior art caster brakes utilize a brake stop that engages the caster wheel and thereby prevents rotation of the wheel. These prior art caster brakes typically include a two-piece housing, with the wheel supported by one of the housing pieces and the brake stop supported by the other. The housing pieces are pivotal relative to one another so that the wheel can be pivoted into contact with the brake stop. One of the housing pieces serves as a foot-activated handle for selectively causing the wheel to be pivoted into engagement with the brake stop. In this manner, the weight of the scaffolding supported by the caster works to maintain the locking engagement between the wheel and the stop.

These prior art caster brakes are problematic and have several undesirable limitations. For example, the prior art brakes cannot be activated by a worker while the worker is supported on the scaffolding platform. It has been determined that in some applications it is desirable for a worker supported on the platform to manually reposition the scaffolding while supported thereon. For example, when using a mobile scaffolding to install ceiling tile (e.g., acoustical tile, etc.), OSHA regulations permit the worker supported on the scaffolding to reposition the scaffolding by pulling it along under the working edge in certain situations. The prior art caster brakes undesirably require the worker to either repeatedly climb up and down the scaffolding to set and unset the brake or require two workers (e.g., one to do the tile work on the platform and one to operate the brake from the ground) to perform the same amount of work a single worker could otherwise accomplish in the same span of time. It has further been determined that unsafe working conditions arise when a worker is supported on the scaffolding platform and the brake is not in a locked position (e.g., if the tile worker previously described fails to set the brake each time) thereby enabling the scaffolding to roll undesirably placing the supported worker in peril of losing balance and/or falling off the scaffolding. The supported worker is at the mercy of other coworkers in the area either setting the brake or refraining from intentionally or unintentionally moving the scaffolding.

SUMMARY OF THE INVENTION

The present invention provides an improved scaffolding brake that does not suffer from the problems and limitations of the prior art brakes detailed above. The inventive brake enables a worker supported on the scaffolding platform to selectively activate the brake while supported on the support platform to restrain motion of the scaffolding and thereby prevent unsafe and inadvertent motion of the scaffolding while the worker is supported thereon.

A first aspect of the present invention concerns a mobile scaffolding for elevating a worker above the ground. The scaffolding broadly includes a frame, a wheel, a platform, and a brake assembly. The frame is vertically elongated between a first end and a second end. The wheel is coupled to the frame adjacent the first end and is operable to rollably support the frame on the ground. The platform is horizontally supported on the frame and is operable to support the worker above the ground. The platform is vertically spaced from the wheel. The brake assembly is associated with the wheel and includes a brake pad and an actuator in communication with the pad. The brake pad is shiftable relative to the wheel into and out of a braking position wherein the wheel is generally prevented from rolling. The actuator is selectively controllable by the worker when the worker is supported on the platform to cause the brake pad to shift into and out of the braking position.

A second aspect of the present invention concerns a brake assembly for use with a mobile scaffolding wherein the scaffolding includes a support surface for supporting a worker elevated above the ground. The brake assembly broadly includes a housing adapted to be coupled to the scaffolding, a handle pivotally coupled to the housing, a brake stop shiftable relative to the housing into and out of a braking position wherein at least a portion of the stop is configured to engage the ground, and an elongated plunger slidable relative to the housing and presenting a first end coupled to the handle and a second end coupled to the brake stop.

A third aspect of the present invention concerns a method of braking a mobile scaffolding broadly including the steps of moving the scaffolding into a working position, positioning a worker on a platform on the scaffolding, and activating a brake from the platform.

A fourth aspect of the present invention concerns a brake assembly for use with a mobile scaffolding wherein the scaffolding includes a support surface for supporting a worker elevated above the ground. The brake assembly broadly includes a housing adapted to be coupled to the scaffolding, a manual handle pivotally coupled to the housing, a brake stop shiftable relative to the housing into and out of a braking position wherein at least a portion of the stop is configured to prevent the scaffolding from moving when the housing is coupled to the scaffolding, and an elongated coupling operably interconnecting the handle and the brake stop so that the brake stop is remotely controllable into and out of the braking position.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

DETAILED DESCRIPTION OF THE PREFERRED EMBODIMENTS

Figure 1:
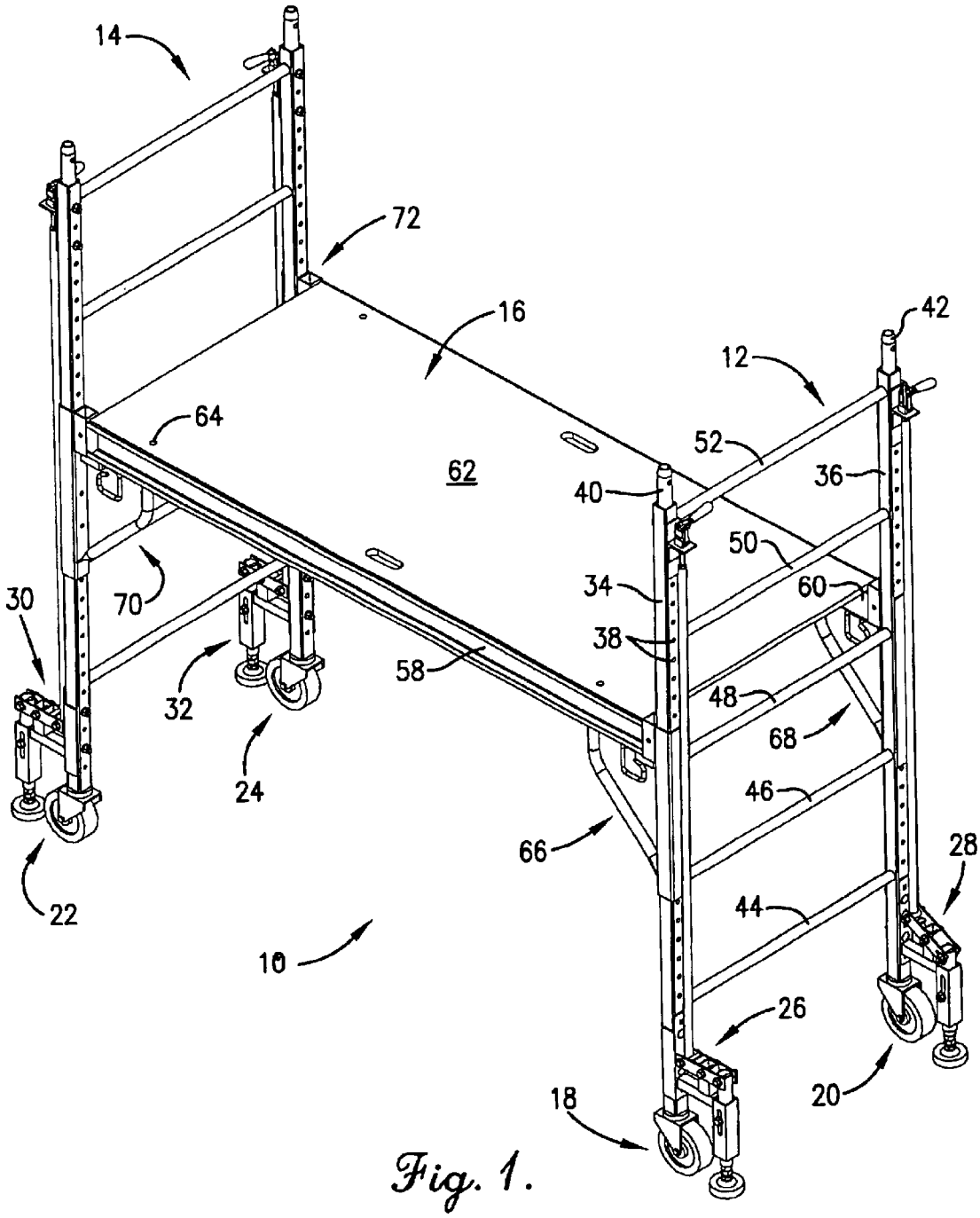
FIG. 1 is a perspective view of a mobile scaffolding constructed in accordance with a preferred embodiment of the present invention and including a brake assembly associated with each of the four casters.
Figure 2:
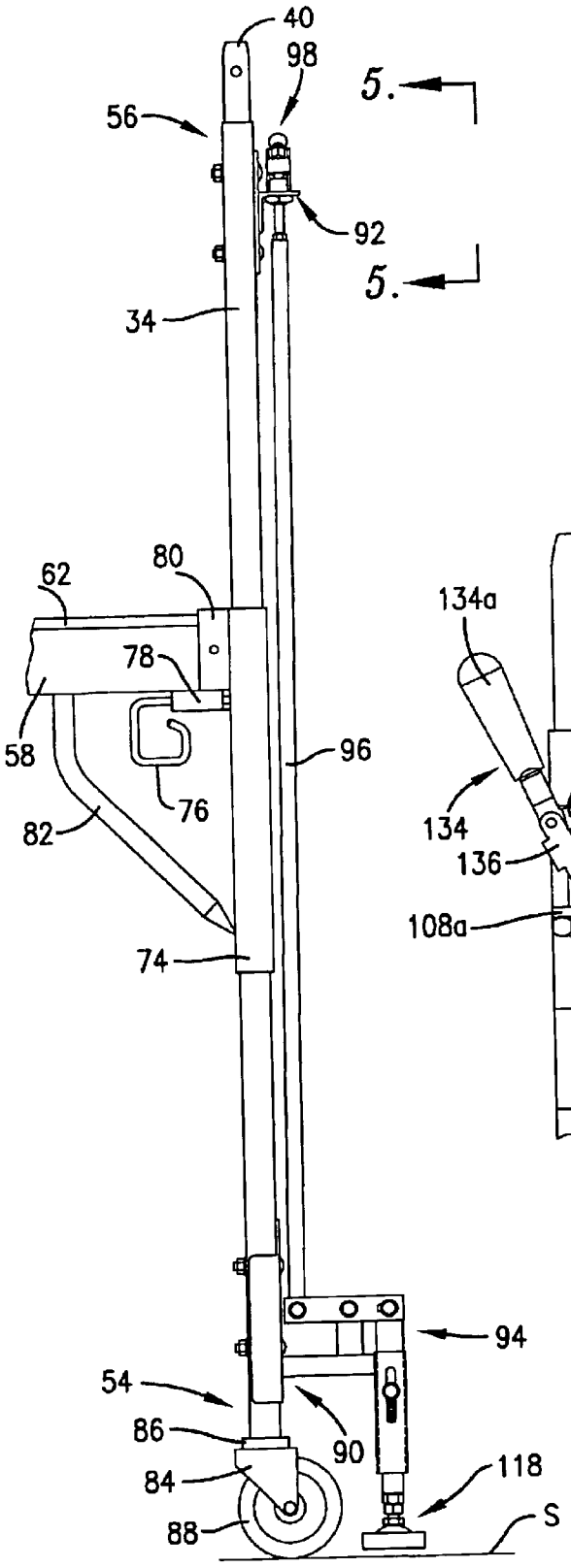
FIG. 2 is a fragmentary side elevational view of the scaffolding shown in FIG. 1 illustrating the components of one of the brake assemblies in the release position.
Figure 4:
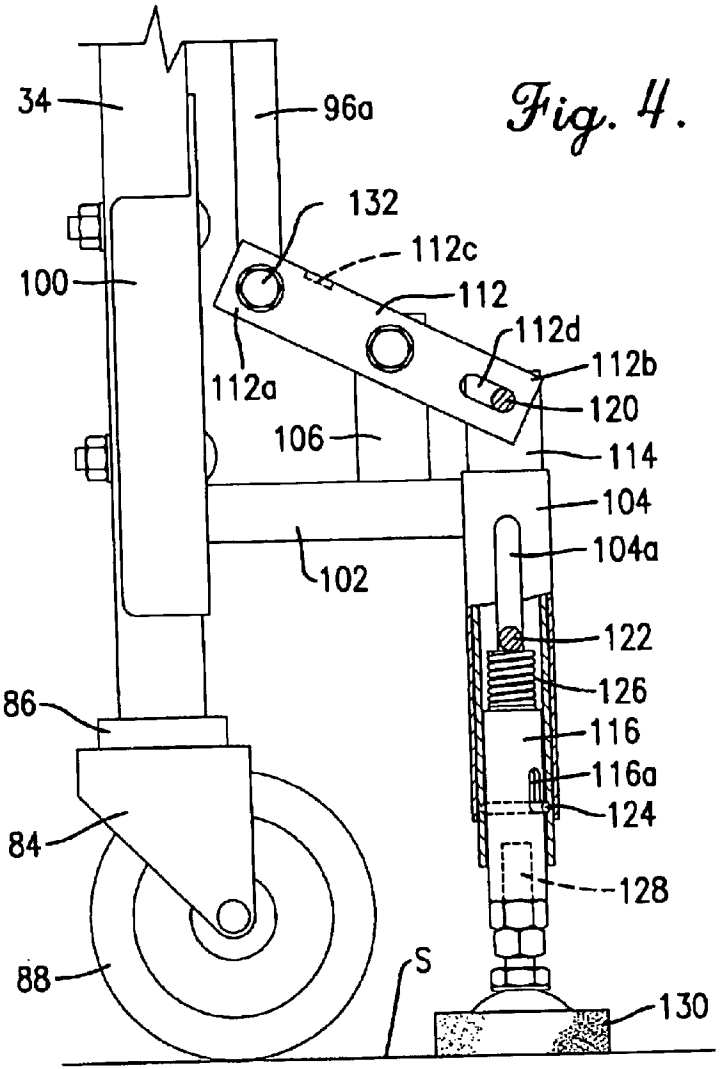
FIG. 4 is a fragmentary enlarged side elevational view of the scaffolding similar to FIG. 3 with the brake assembly shown in the braking position.
Figure 3:
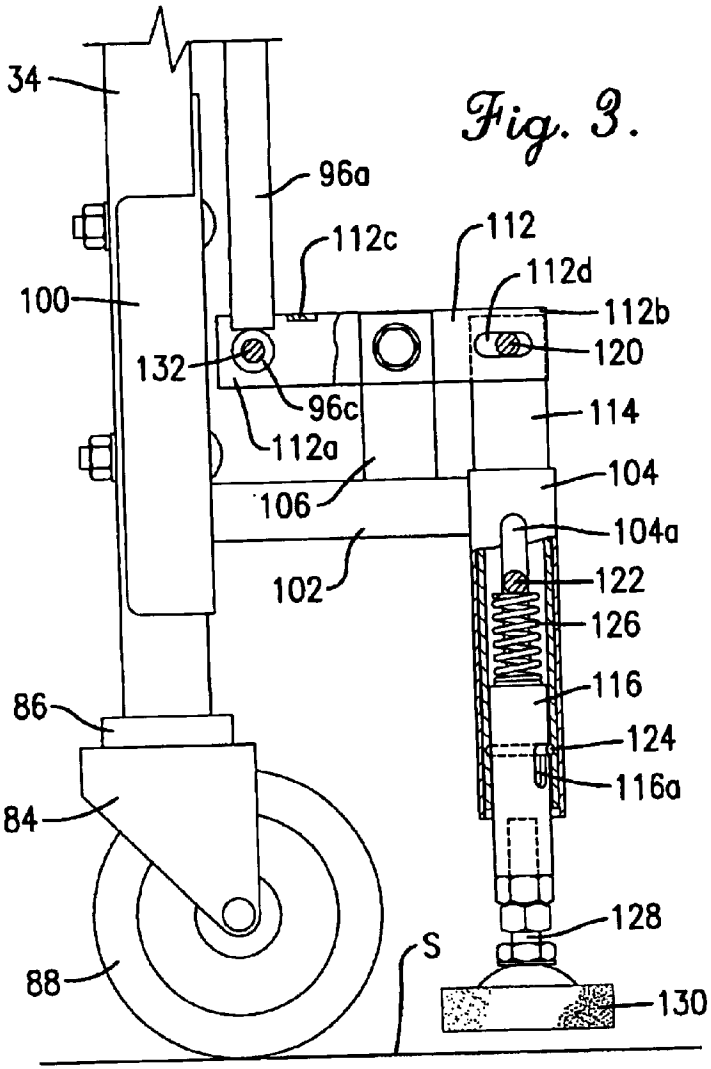
FIG. 3 is a fragmentary enlarged side elevational view of the scaffolding shown in FIG. 2 with portions of the brake stop shown in section and illustrating the brake assembly in the release position.

FIG. 1 illustrates a mobile scaffolding 10 constructed in accordance with a preferred embodiment of the present invention and configured for elevating a worker (not shown) above a floor or ground surface S (see FIGS. 2–4). The illustrated scaffolding 10 utilizes a pair of rollable ladder-type frames to support a vertically-adjustable platform therebetween. However, the principles of the present invention are not limited to this scaffolding configuration and equally apply to virtually any type of scaffolding so long as the scaffolding supports an elevated worker and is movable (e.g., rollable, etc.). The illustrated scaffolding 10 broadly includes a pair of frames 12 and 14, a platform 16 supported by the frames 12,14, a pair of casters 18, 20 and 22, 24 rollably supporting a respective one of the frames 12,14, and a brake assembly 26, 28, 30, and 32 associated with a corresponding one of the casters 18,20,22,24, respectively.

In more detail, each of the frames 12,14 is configured to elevate the platform 16 vertically above the floor or ground surface S and support the platform 16 once elevated. The frames 12,14 are virtually identically configured, therefore, only the frame 12 will be described in detail with the understanding that the frame 14 is similarly constructed. The frame 12 includes a pair of spaced apart vertically extending support posts 34 and 36. Each of the posts 34,36 are generally tubular in configuration presenting a hollow, generally square shaped cross section. For purposes that will subsequently be described, a plurality of spaced apertures 38 are formed in each of the posts 34,36 and extend through the respective post 34,36 to form an axially aligned pin-receiving passageway. As will subsequently be described, the lower ends of each of the posts 34,36 are open and configured to receive various attachment components, such as one of the casters 18,20,22,24. Formed in the upper end of each of the posts 34,36 is a corresponding coupling shaft 40 and 42, respectively. Each of the shafts 40,42 is configured to removably receive various attachment components, such as guard rails, another frame member, etc. Fixed to each of the posts 34,36 and extending horizontally therebetween, are a plurality of rung members 44, 46, 48, 50, and 52. The rungs 44,46,48,50,52 are spaced from one another and configured to enable the worker to climb up and down the rungs (e.g., in order to reach and exit the platform 16). The frame 12 defines a first, lower end 54 adjacent the rung 44 and a second, upper end 56 adjacent the rung 52 (see FIGS. 1–2).

One exemplary frame is disclosed in pending application for U.S. Letters patent Ser. No. 09/766,334, filed Jan. 19, 2001, entitled UTILITY SCAFFOLDING HAVING SAFETY FEATURES (sharing a common inventor with the present application and hereinafter "the Wyse '334 application"), which is hereby incorporated by reference herein as is necessary for a full and complete understanding of the present invention. However, the frame could be variously constructed and configured. For example, the frame need not utilize a tubular construction and need not be a ladder-type frame.

The platform 16 is supported horizontally between the frames 12 and 14 and is vertically adjustable between the upper and lower ends of the frames 12,14. Particularly, the platform 16 includes a pair of horizontally extending side rails 58 and 60 that support a generally flat work surface 62. The illustrated work surface 62 is removably coupled to the rails 58,60 by a plurality of transverse pins 64. Although not shown, the platform 16 preferably includes rail pins and platform clips that can be pivoted into a locking position once the surface 62 is placed on the rails 58,60 to prevent the surface 62 from dislodging from the pins 64. Exemplary rail pins and clips are disclosed in the Wyse '334 application, previously incorporated herein by reference. The illustrated platform 16 further includes a pair of bracket assemblies 66, 68 and 70, 72 associated with each of the frames 12,14, respectively. The paired bracket assemblies 66,68 and 70,72 include assemblies that are mirror images of each other, but otherwise each of the assemblies 66,68,70,72 are virtually identically configured and therefore only the bracket assembly 66 will be described in detail with the understanding that the assemblies 68,70,72 are similarly constructed. The bracket assembly 66 includes a sleeve 74 slidably received on the post 34 of the frame 12. The sleeve 74 is generally C-shaped in cross section to define an open side configured to clear the rungs 44,46,48,50,52 as the sleeve slides relative to the frame 12. The sleeve 74 includes a plurality of apertures formed on the inside surface that are complementally spaced to match the spacing of the apertures 38 formed in the post 34 (not shown on the assembly 66, but see the bracket assembly 70). In this manner, the sleeve apertures are operable to axially align with the post apertures 38. In this regard, the bracket assembly 66 further includes a G-shaped pin 76 that is slidably received in the axially aligned apertures to retain the platform 16 in a selected vertical position relative to the frame 12. The G-shaped pin 76 preferably slides in a pin guide 78 and is biased into the aligned holes by a spring (not shown). Although not shown, the bracket assembly 66 preferably includes an additional locking pin slidably received in a second set of axially aligned apertures to lock the platform 16 in the selected vertical position. It is within the ambit of the present invention to utilize various alternative locking mechanisms and exemplary pin-type mechanisms are disclosed in the Wyse '334 application previously incorporated herein.

The sleeve 74 is fixed to the rail 58 by a block 80 and by a gusset 82. In this manner, the rail 58, and thus the work surface 62 supported thereon, slides with the sleeve 74 relative to the frame 12. The block 80 is open on its upper end and includes means for securing attachment components in the block 80 (e.g., the illustrated block 80 is configured to receive a guard rail (not shown) and includes a pin-receiving aperture to removably secure the guard rail in the block 80). The gusset 82 provides additional support to the rail 58 relative to the sleeve 74.

One exemplary platform is disclosed in the previously incorporated Wyse '334 application. However, the platform could be variously constructed and configured, for example, the platform need not be adjustable, and could be fixedly supported along the frames, or on top of the frames.

The illustrated scaffolding 10 is a mobile scaffolding. In more detail, each of the frames 12,14 are supported by a corresponding pair of the casters 18,20 and 22,24, respectively. Each of the casters 18,20,22,24 are virtually identically configured and therefore only the caster 18 will be described in detail with the understanding that the casters 20,22,24 are similarly constructed. The caster 18 is swively received in the open lower end of the post 34 of the frame 12. In one manner known in the art, the caster 18 includes a caster housing 84, a stub shaft 86 swively coupled to the housing 84, and a wheel 88 rollably supported in the housing 84. The caster housing 84 supports the post 34 on the wheel 88. The stub shaft 86 is removably received in the open lower end of the post 34 and is configured to be locked in the post 34. For example, the illustrated shaft 86 includes an aperture (not shown) that aligns with the lower-most pin-receiving passageway formed by the bottom apertures 38 in the post 34. In this manner, a retaining pin (not shown) can be inserted through the post 34 and the stub shaft 86 to retain the shaft in the lower end of the post 34. The stub shaft 86 includes a bearing ring formed in its lower end that carries a bearing (not shown) to allow the caster housing 84 and thus the wheel 88 to swivel relative to the stub shaft 86 while still supporting the weight of the frame 12 and the platform 16 carried by the post 34. The wheel 88 is axled to the housing 84 so that the wheel 88 is free to roll relative thereto. In this manner, the casters 18,20,22,24 cooperate to provide mobility to the scaffolding 10. It is within the ambit of the present invention to utilize various alternatively configured means for providing mobility to the scaffolding 10. However, it is important that the scaffolding be enabled to move relative to the supporting floor or ground surface S.

The mobile scaffolding 10 can be prevented from moving relative to the supporting floor or ground surface S by the brake assemblies 26,28,30,32 associated with each of the casters 18,20,22,24. The inventive brake assemblies 26,28,30,32 enable the worker to select and control when the mobile scaffolding 10 is prevented from moving while the worker is elevated on the platform 16. Each of the brake assemblies 26,28,30,32 are virtually identically configured and therefore only the brake assembly 26 will be described in detail with the understanding that the brake assemblies 28,30,32 are similarly constructed. The illustrated brake assembly 28 includes a lower brake housing 90, an upper brake housing 92, a brake stop subassembly 94, a plunger 96, and a handle subassembly 98 (see FIGS. 1–2). In more detail, and as shown in FIGS. 3–4, the lower brake housing 90 includes a bracket 100 that is coupled to the lower end of the post 34 of the frame 12 adjacent the caster 18. The illustrated bracket 100 is bolted to the post 34 through a pair of the pin-receiving passageways formed by the aligned apertures 38 in the post 34. The lower brake housing 90 further includes a transverse bar 102 fixed to the bracket 100 and extending generally orthogonally therefrom. For purposes that will described below, the bar 102 is dimensioned and configured so that its distal end (the end opposite the bracket 100) extends over and sufficiently past the wheel 88 of the caster 18. For purposes that will subsequently be described, the lower brake housing 90 includes a tubular sleeve 104 fixed to the distal end of the transverse bar 102. The illustrated sleeve 104 extends generally parallel to the post 34 of the frame 12 and is open along its entire axial length and at both its upper and lower ends. For purposes that will subsequently be described, the sleeve 104 includes a vertical slot 104*a* formed in the tubular wall of the sleeve 104 and configured to slidably receive a pin or bolt so that the pin and/or bolt received in the slot 104*a* passes through the sleeve 104 and extends out of the tubular wall of the sleeve 104 at diametrically opposite locations. As will be described below, the lower brake housing 90 further includes a fulcrum post 106 fixed to and extending upwardly from the transverse bar 102. The fulcrum post 106 is spaced from the sleeve 104 and positioned between the bracket 100 and the sleeve 104.

The upper brake housing 92 is coupled to the upper end of the post 34 of the frame 12 and includes a bracket 108 and a bushing block 110. The illustrated bracket 108, similar to the bracket 100, is bolted to the post 34 through a pair of the pin-receiving passageways formed by the aligned apertures 38 in the post 34. The bracket 108 includes a portion 108*a* that extends generally transversely from the post 34 and includes an opening (not shown). The bushing block 110 is fixed to the bracket portion 108*a*. In the illustrated upper brake housing 92, the bushing block includes a section that extends through the opening in the bracket portion 108*a* and includes external threads that receive a bushing block nut 110*a* to couple the bushing block 110 to the bracket portion 108*a*. As will be subsequently described, the bushing block 110 is configured to slidably receive at least a portion of the plunger 96.

The lower and upper brake housings 90,92 are removably couplable to the frame 12. In this regard, the brake assembly 26 can be easily added on, or coupled to, existing scaffolding. However, it is within the ambit of the present invention to utilize various alternative configurations for the brake housings 90,92. For example, the housings could be integrally formed with the scaffolding frame during the original manufacture thereof.

The brake stop subassembly 94 is shiftably coupled to the lower brake housing 90 and is shiftable between a braking position as shown in FIG. 4, wherein the wheel 88 of the caster 18 is generally prevented from moving relative to the floor or ground support surface S, and a release position as shown in FIG. 3, wherein the wheel 88 is free to move. Particularly, the brake stop subassembly 94 includes a pivot bar 112, an upper tube 114, a lower shaft 116, and a brake stop 118. The pivot bar 112 presents a proximate end 112*a* generally adjacent the post 34 of the frame 12, and an opposite, distal end 112*b* spaced from the proximate end 112*a*. The pivot bar 112 is pivotally coupled to the fulcrum post 106 of the lower brake housing 90 generally between the ends 112*a,b* of the pivot bar 112. The illustrated pivot bar 112 presents a pair of side panels, spaced apart by a cross bar 112*c*, that straddle the fulcrum post 106 and are bolted together through the post 106. When the brake stop subassembly 94 is in the release position, the pivot bar 112 is generally parallel to the transverse bar 102 of the lower brake housing 90 (see FIG. 3). When the brake stop subassembly 94 is in the braking position, the proximate end 112*a* of the pivot bar 112 is further spaced from the transverse bar 102 and the distal end 112*b* is closer to the transverse bar 102 (see FIG. 4). For purposes that will subsequently be described, formed in the distal end 112*b* of the pivot bar 112 is a longitudinally extending bolt-receiving slot 112*d*.

The upper tube 114 of the brake stop subassembly 94 is slidably received within the sleeve 104 of the lower brake housing 90. The upper tube 114 includes three pins fixed relative to the tube 114 and extending diametrically through the center of the tube 114, an upper pin 120, an intermediate pin 122, and a lower pin 124. The upper end of the tube 114 is received between the side panels of the pivot bar 112 and the upper pin 120 extends through the upper end of the tube 114 so that it is slidably received within the bolt-receiving slot 112*d* of the pivot bar 112. In this manner, when the pivot bar 112 pivots, the movement of the distal end 112*b* causes the upper tube 114 to slide relative to the sleeve 104. For purposes that will subsequently be described, the intermediate pin 122 extends through the tube 114 and is positioned so that it is slidably received in the vertical slot 104*a* of the sleeve 104. As will subsequently be described, the lower pin 124 is positioned adjacent the lower end of the tube 114. The lower pin 124 need not necessarily extend through the outer wall of the tube 114. However, as will become apparent below, for assembly purposes, the lower pin 124 is preferably inserted after the lower tube 116 is slidably received inside the upper tube 114 (e.g., spring-biased and/or detented against the inside wall of the sleeve 104, etc.).

The lower shaft 116 is slidably received within the lower end of the upper tube 114 so that the lower end of the shaft 116 extends out of the lower end of the upper tube 114. Particularly, the lower shaft 116 includes a horizontal slot 116*a* formed in its wall that is configured to slidably receive the lower pin 124 of the upper tube 114. In this manner, the lower shaft 116 has a limited range of slidable motion relative to the upper tube 114, yet still is caused to generally shift relative to the sleeve 104 when the upper tube 114 shifts relative to the sleeve 104. The lower shaft 116 slides relative to the upper tube 114 between an extended position as shown in FIG. 3, wherein the shaft 116 is extends out of the upper tube 114 until the top of the slot 116*a* engages the lower pin 124 of the upper tube 114, and a retracted position as shown in FIG. 4, wherein the shaft 116 retracts into the upper tube 114 until the bottom of the slot 116*a* engages the lower pin 124 of the upper tube 114. The lower shaft 116 is spring biased into the extended position by a spring 126. The top end of the spring 126 rides against the intermediate pin 122 of the upper tube 114 and the lower end of the spring 126 rides against the upper end of the shaft 116. In this manner, the spring force of the spring 126 must be overcome to cause the shaft 116 to slide into the retracted position as shown in FIG. 4. For purposes that will be described below, the lower end of the shaft 116 includes internal threading.

The brake stop 118 is fixed to the lower end of the shaft 116 and thus is caused to move with the shaft 116. The stop 118 includes a threaded shaft 128 and a disk 130. The upper end of the threaded shaft 128 threads into the internal threads of the lower end of the shaft 116 and the lower end of the threaded shaft 128 is coupled to the disk 130. The illustrated stop 118 includes locking nuts 132 so that the position of the stop 118 relative to the lower shaft 116 can be adjusted and locked into the desired position once adjusted. The disk 130 presents a relatively flat bottom surface that engages the floor or ground support surface S when the brake stop subassembly 94 is in the braking position (see FIG. 4) and is spaced from the floor or ground surface S when the subassembly 94 is in the release position (see FIG. 3). The engagement between the disk 130 and the floor or ground surface S prevents the wheel 88 of the caster 18 from moving relative thereto. Accordingly, the disk must be sufficiently strong to withstand engagement with the surface S and the bottom surface of the disk 130 is preferably formed from a material having gripping properties such as various plastic polymers, rubber, etc. The illustrated disk 130 is formed from metal (e.g., steel, aluminum, etc.) and covered with an industrial grade softer rubber. The range of motion provided between the extended and retracted positions of the lower shaft 116 enables the disk 130 to grippingly engage a floor or ground surface that is not uniformly even. However, the disk 130 preferably is pivotal relative to the threaded shaft 128 (e.g., coupled thereto with a ball joint, etc.) to facilitate gripping engagement of uneven support surfaces. Additionally, the spring force of the spring 126 facilitates the gripping engagement of the disk 130 with the floor or ground surface S.

The plunger 96 extends between the lower and upper brake housings 90,92 and transfers movement of the handle subassembly 98 to the brake stop subassembly 94. In this regard, the illustrated plunger 96 is a rigid rod presenting a bottom end 96*a* and an opposite, spaced top end 96*b*. The bottom end 96*a* is pivotally coupled to the proximate end 112*a* of the pivot bar 112 of the brake stop subassembly 94. The bottom end 96*a* of the illustrated plunger 96 includes a collar 96*c* that is received between the side panels of the pivot bar 112 and rotatably receives a bolt 132 coupled to the panels of the bar 112 (see FIGS. 3 and 4). The top end 96*b* is slidably received through the bushing block 110 of the upper brake housing 92. The top end 96*b* of the illustrated plunger 96 includes a stub shaft 96*d* that is dimensioned and configured to slide within the opening of the bushing block 110 and extend out of the top and bottom of the bushing block 110. In this manner, the stub shaft 96*d* can be formed from a strong durable material that can be machined to the desired size (e.g., steel, etc.) while the other portions of the plunger 96 can be formed from a relatively cheaper, light weight material (e.g., various plastic polymers, etc.).

Figure 5:
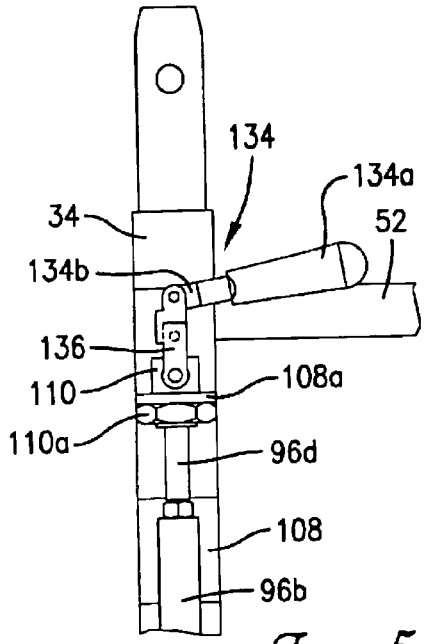
FIG. 5 is a fragmentary enlarged side elevational view of the scaffolding taken substantially along line 5—5 of FIG. 2 with the handle subassembly pivoted to the release position.
Figure 6:
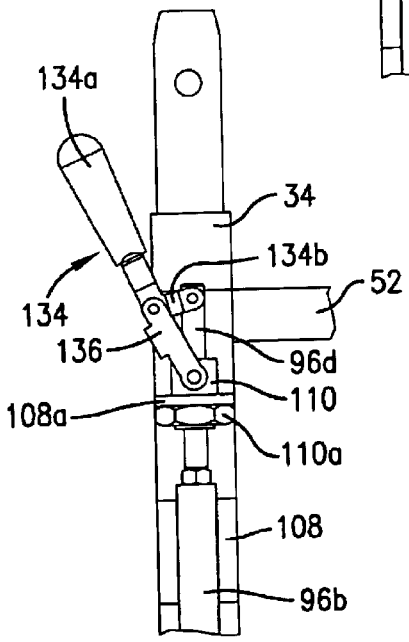
FIG. 6 is a fragmentary enlarged side elevational view of the scaffolding similar to FIG. 5 with the handle subassembly shown between the release and braking positions.
Figure 7:
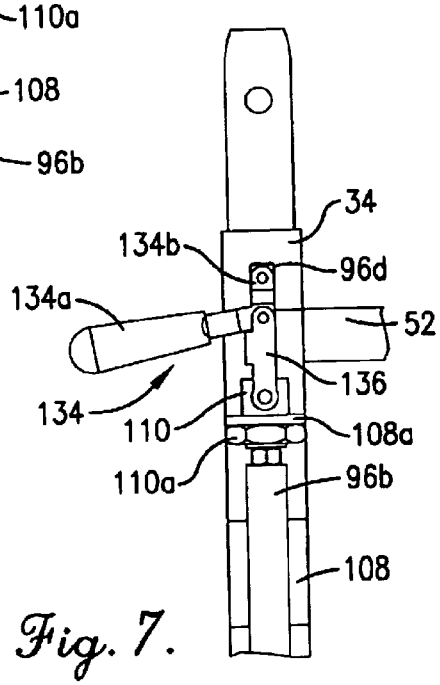
FIG. 7 is a fragmentary enlarged side elevational view of the scaffolding similar to FIG. 6 with the handle subassembly shown in the braking position.

Turning to FIGS. 5–7, the handle subassembly 98 is coupled to the upper brake housing 92 and enables a worker supported on the scaffolding 10 to shift the brake stop subassembly 94 into and out of the braking position to selectively prevent movement of the scaffolding 10. In more detail, the handle subassembly 98 includes a handle 134 and a guide bracket 136. The handle 134 is generally L-shaped and presents a grip 134*a* at one end and a coupling fork 134*b* that elbows out of the opposing end. The coupling fork 134*b* is pivotally coupled to the top end portion of the stub shaft 96*d* of the plunger 96 that extends out of the top of the bushing block 110. The guide bracket 136 is pivotally coupled to the elbow of the handle 134 at one end and pivotally coupled to the bushing block 110 at the opposite end. The handle 134 is pivotal from the position shown in FIG. 5, wherein the grip 134*a* is oriented toward the post 36 of the frame 12 and somewhat parallel to the rung 52 of the frame 12, to the position shown in FIG. 7, wherein the grip 134*a* is oriented away from the post 36 and somewhat parallel with the rung 52, with the position shown in FIG. 6 being the intermediate, center position, wherein the grip 134*a* is not at all parallel with the rung 52. When the handle 134 is in the position shown in FIG. 5, the top end 96*b* of the plunger 96 is adjacent the bushing block 110 corresponding to the brake stop subassembly 94 being in the release position as shown in FIG. 3. As the handle 134 is pivoted toward the center position shown in FIG. 6, the weight of the plunger 96 must be overcome and the top end 96*b* of the plunger 96 is caused to slide up and away from the top of the bushing block 110. As the fork 134*b* pivots relative to the plunger end 96*b*, the elbow of the handle 134 pivots relative to the guide bracket 136. In this manner, the handle subassembly 98 transfers only straight-line motion to the plunger 96. As the handle 134 is pivoted past the center position shown in FIG. 6, the handle 134 is urged into the position shown in FIG. 7. When the handle 134 is in the position shown in FIG. 7, the top end 96*b* of the plunger 96 is spaced upwardly from the top of the bushing block 110 corresponding to the brake stop subassembly 94 being in the braking position as shown in FIG. 4. The weight of the plunger 96 and the configuration of the handle subassembly 98 cooperate to maintain the handle 134 in the position shown in FIG. 7. In order to pivot the handle 134 back into the position shown in FIG. 5, the weight of the plunger 96 must again be overcome until the handle 134 pivots past the center position shown in FIG. 6. Once the handle 134 pivots past the center position, the weight of the plunger 96 urges the handle 134 back into the position shown in FIG. 5 and maintains the handle 134 in that position. In this regard, the illustrated handle subassembly 98 is a straight-line over-the-center-type clamp. One such suitable clamp is available from DE-STA-CO Industries of Madison Heights, Mich. as Model No. 604.

As previously indicated, the braking assemblies 28,30,32 are virtually identically configured as the braking assembly 26. However, it is within the ambit of the present invention to utilize a single braking assembly, or the inventive braking assembly in combination with traditional caster brakes, as well as various alternatively configured braking assemblies. For example, the brake assembly need not utilize a brake stop that engages the ground to prevent movement of the scaffolding, but rather could implement traditional-type brake stops that engage the wheel to prevent movement. Additionally, the brake assembly need not utilize a pivotal handle or a rigid plunger to activate the brake stop. For example, the brake assembly could utilize an electronically activated brake stop with a remotely located controller, or hard wire linkage. However, it is important that the brake stop be capable of activation by the worker while the worker is supported on the scaffolding in order to prevent movement of the scaffolding.

In operation, the scaffolding 10 is assembled and rolled into the desired work position on the supporting floor or ground. The worker then mounts the scaffolding 10 (e.g., by climbing up the rungs 44,46,48,50,52) so that the worker is supported on the platform 16. In order to activate the braking assembly 26, the worker grasps the grip 134*a* of the handle 134 and pivots the handle 134 from the position shown in FIG. 5 to the position shown in FIG. 7. As the handle 134 is pivoted, the plunger 96 is pulled upward. As the plunger 96 is pulled upward, the brake stop subassembly 94 is caused to shift from the release position shown in FIG. 3 to the braking position shown in FIG. 4. The braking assemblies 28,30,32 can be similarly activated. The mobile scaffolding 10 is now prevented from moving and the worker is securely supported on the platform 16 for safe working. If the worker desires to deactivate one or more of the braking assemblies, the above described steps are simply reversed. Once the braking assemblies are deactivated, the mobile scaffolding 10 can be rolled to the next desired work position (e.g., the supported worker can pull the scaffolding 10 along the supporting surface S). Once the scaffolding 10 is repositioned, the worker can reactivate the braking assemblies from the platform 16.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the doctrine of equivalents to determine and assess the reasonably fair scope of the present invention as pertains to any apparatus not materially departing from but outside the literal scope of the invention as set forth in the following claims.

What is claimed is:

1. A mobile scaffolding for elevating a worker above the ground, said scaffolding comprising:

a frame vertically elongated between a first end and a second end;

a wheel coupled to the frame adjacent the first end and being operable to rollably support the frame on the ground;

a platform horizontally supported on the frame and being operable to support the worker above the ground, said platform being vertically spaced from the wheel; and a brake assembly associated with the wheel and including a brake pad and an actuator in communication with the pad, said brake pad being shiftable relative to the wheel into and out of a braking position wherein the wheel is generally prevented from rolling, said actuator selectively controllable by the worker when the worker is supported on the platform to cause the brake pad to shift into and out of the braking position, said actuator including a manual controller spaced above the platform and configured to permit selective control of the brake pad into and out of the braking position.

2. The scaffolding as claimed in claim 1, said actuator including a handle pivotal relative to the frame.

3. The scaffolding as claimed in claim 2, said handle being positioned adjacent the second end of the frame.

4. The scaffolding as claimed in claim 3, said brake assembly further including an elongated plunger slidable relative to the frame and presenting a proximate end adjacent the handle and a distal end adjacent the brake pad.

5. The scaffolding as claimed in claim 1, said brake pad including a generally flat disc that engages the ground when the brake pad is in the braking position.

6. A mobile scaffolding for elevating a worker above the ground, said scaffolding comprising:

a frame vertically elongated between a first end and a second end;

a wheel coupled to the frame adjacent the first end and being operable to rollably support the frame on the ground;

a platform horizontally supported on the frame and being operable to support the worker above the ground, said platform being vertically spaced from the wheel; and a brake assembly associated with the wheel and including a brake pad and an actuator in communication with the pad, said brake pad being shiftable relative to the wheel into and out of a braking position wherein the wheel is generally prevented from rolling, said actuator selectively controllable by the worker when the worker is supported on the platform to cause the brake pad to shift into and out of the braking position, at least a portion of said actuator being positioned in proximity to the platform to enable the worker to control the actuator from the platform, said actuator including a handle pivotal relative to the frame, said handle being positioned adjacent the second end of the frame, said brake assembly further including an elongated plunger slidable relative to the frame and presenting a proximate end adjacent the handle and a distal end adjacent the brake pad, said handle being coupled to the proximate end of the plunger so that pivoting of the handle causes the plunger to slide relative to the frame.

7. The scaffolding as claimed in claim 6, said brake pad being coupled to the distal end of the plunger so that sliding of the plunger relative to the frame causes the pad to shift into and out of the braking position.

8. A brake assembly for use with a mobile scaffolding wherein the scaffolding includes a support surface for supporting a worker elevated above the ground, said brake assembly comprising:

a housing adapted to be coupled to the scaffolding;

a handle pivotally coupled to the housing;

a brake stop shiftable relative to the housing into and out of a braking position wherein at least a portion of the stop is configured to engage the ground; and an elongated plunger slidable relative to the housing and presenting a first end coupled to the handle and a second end coupled to the brake stop, said housing including a first section adapted to be coupled to the scaffolding and a second section adapted to be coupled to the scaffolding and being spaced from the first section so that when the first and second sections are coupled to the scaffolding the support surface is positioned between the first and second sections.

9. The brake assembly as claimed in claim 8, said handle being pivotally coupled to the first section of the housing.

10. The brake assembly as claimed in claim 9, said brake stop being slidably coupled to the second section of the housing.

11. A brake assembly for use with a mobile scaffolding wherein the scaffolding includes a support surface for supporting a worker elevated above the ground, said brake assembly comprising:

a housing adapted to be coupled to the scaffolding;

a handle pivotally coupled to the housing;

a brake stop shiftable relative to the housing into and out of a braking position wherein at least a portion of the stop is configured to engage the ground; and an elongated plunger slidable relative to the housing and presenting a first end coupled to the handle and a second end coupled to the brake stop, said brake stop including a lever pivotally coupled to the housing and presenting a proximate end adjacent the scaffolding when the housing is coupled to the scaffolding and a distal end spaced from the proximate end, said plunger being pivotally coupled to the proximate end of the lever.

12. The brake assembly as claimed in claim 11, said brake stop further including a disk coupled to the distal end of the lever.

13. The brake assembly as claimed in claim 12, said brake stop further including a tube coupled to the distal end of the lever and a shaft slidably received within the tube, said disk being coupled to the shaft.

14. The brake assembly as claimed in claim 13, said shaft being yieldably biased away from the lever.

15. A brake assembly for use with a mobile scaffolding wherein the scaffolding includes a support surface for supporting a worker elevated above the ground, said brake assembly comprising:

a housing adapted to be coupled to the scaffolding;

a manual handle pivotally coupled to the housing;

a brake stop shiftable relative to the housing into and out of a braking position wherein at least a portion of the stop is configured to prevent the scaffolding from moving when the housing is coupled to the scaffolding; and an elongated coupling operably interconnecting the handle and the brake stop so that the brake stop is remotely controllable into and out of the braking position, said housing including a first section adapted to be coupled to the scaffolding and a second section adapted to be coupled to the scaffolding and being spaced from the first section so that when the first and second sections are coupled to the scaffolding the support surface is positioned between the first and second sections.

16. The brake assembly as claimed in claim 15, said handle being pivotally coupled to the first section of the housing.

17. The brake assembly as claimed in claim 16, said brake stop being slidably coupled to the second section of the housing.

18. The brake assembly as claimed in claim 17, said coupler comprising a plunger slidable relative to the first and second sections of the housing and presenting a first end coupled to the handle and a second end coupled to the brake stop.

19. The brake assembly as claimed in claim 15, said at least a portion of the brake stop including a ground-engageable disk which engages the ground when the brake stop is in the braking position.

* * * * *